US005368623A

United States Patent [19]

Hirschmann et al.

[11] Patent Number: 5,368,623

[45] Date of Patent: Nov. 29, 1994

[54] PROCESS AND APPARATUS FOR THE CONTINUOUS PRODUCTION OF MINERAL WOOL NONWOVENS

[75] Inventors: Klemens Hirschmann, Ilvesheim; Joachim Mellem, Schriesheim, both of Germany

[73] Assignee: Grunzweig & Hartmann AG, Ludwigshafen, Germany

[21] Appl. No.: 176,472

[22] Filed: Jan. 3, 1994

Related U.S. Application Data

[63] Continuation of Ser. No. 912,171, Jul. 13, 1992, Pat. No. 5,296,013.

[30] Foreign Application Priority Data

Dec. 17, 1991 [DE] Germany ..... 4141659

[51] Int. Cl.[5] ..... C03B 37/06

[52] U.S. Cl. ..... 65/454; 65/505; 65/524

[58] Field of Search ..... 65/4.4, 5, 12:9, 16; 156/62.4

[56] References Cited

U.S. PATENT DOCUMENTS 3,787,195 1/1974 Kircheim ..... 65/9

4,487,622 12/1984 Battigelli et al. ..... 65/4.4

FOREIGN PATENT DOCUMENTS 0194605 9/1986 European Pat. Off. .

0547588A1 6/1993 European Pat. Off. .

2247346 5/1975 France .

3921399 1/1991 Germany .

*Primary Examiner*—Robert L. Lindsay

*Attorney, Agent, or Firm*—Oblon, Spivak, McClelland, Maier & Neustadt

[57] ABSTRACT

The objective is to provide a process and an apparatus for the continuous production of mineral wool nonwovens, by means of which a stable flow pattern is created in the chute, thus facilitating a clearly defined, homogeneous layer of deposited mineral wool.

According to the invention, at least one backflow region (24, 25) is generated in the chute (9) outside the fibre flow (23), which backflow region (24, 25) is sufficient for such a large-volume backflow with such a low mean velocity that appreciable upward fibre transport is avoided. In this connection, a portion (32) of the process air entrained with the fibre flow is deflected upward in the backflow, and another portion (34) of the process air is extracted.

4 Claims, 2 Drawing Sheets

1
2
3
4
9a
9b
9c
9d
48
20
49
21
50
22
51
5
6
7
8
16
17
18
19
9
24
25
23
26
30
31
27
29
28
32
32
37
34
34
37
36
33
35
33
36
43
44
10
45
47
46
42
42
38
39
11
15
41
40
a
b
a

PROCESS AND APPARATUS FOR THE CONTINUOUS PRODUCTION OF MINERAL WOOL NONWOVENS

This is a continuation of application Ser. No. 07/912,171, filed on Jul. 13, 1992 now U.S. Pat. No. 5,296,013.

BACKGROUND OF THE INVENTION

The invention relates to a process and an apparatus for continuous production of nonwovens, particularly mineral wool nonwovens.

In the production of mineral wool nonwovens, e.g. from rock wool or glass wool, not only is the fiberisation process of importance, but also the formation of the nonwoven fabric as such constitutes an important process step. It is customary in this respect for a fibre/gas-/air mixture produced by a fiberisation unit to be introduced into a box-like so-called chute to separate the fibres, which chute usually features at the bottom an accumulating conveyor acting as a type of filter screen which is constructed in the form of a gas-permeable, rotating, plane conveyor belt. Under the conveyor belt is located an extraction device which generates a certain partial vacuum. In addition, drum-shaped accumulating conveyors with curved suction surfaces are also known from, for example, German patent specification DE-PS 39 21 399.

If the fibre/gas/air mixture—which can also contain a binder—impinges on the accumulating conveyor, the gas/air mixture is sucked through to below the accumulating conveyor acting as a filter, and the fibres are retained on the conveyor in the form of a nonwoven fabric.

In the known process for nonwoven fabric production, there are generally a plurality of adjacently arranged fiberisation units which produce fibre flows in a manner familiar to a person knowledgeable in the art. For the sake of simplicity, the term "fibre flow" or "fibre stream" used in the following shall refer to the flow bundle comprising fibres, process air, and binder where appropriate, with the term "process air" also covering the propellant gas required in order to draw out the fibres, the secondary air entrained during fiberisation, and any false air which may be sucked into the process for the purpose of cooling following fibre drawing.

Into the space bounded by the accumulating conveyor and the side walls of the chute, are thus introduced from the top fibre flows arranged in the form of adjacent core streams which carry fibres which are in the process of production or which have just been produced. In order to facilitate a directed flow and orderly deposition of the fibres as a nonwoven fabric on the accumulating conveyor, it is therefore necessary to extract the introduced process air from below the accumulating conveyor. By this means, one obtains in the chute a vertical stream of the fibre flows, from which the fibre content is trapped at the accumulating conveyor, as if at a filter, to form a nonwoven fabric which is then conveyed away while the process air continues to flow to extraction devices.

The extraction process under and in the accumulating conveyor presents certain difficulties as extraction has to be performed through the forming wool nonwoven, so that at the beginning of nonwoven formation there is, of necessity, less flow resistance while after partially completed nonwoven formation, a greater level of flow resistance has to be overcome. Directly above the nonwoven formation zone, therefore, a non-uniform flow pattern prevails owing to the spatially differing thicknesses of the nonwoven fabric lying below.

At the entry end of the chute, i.e. above the nonwoven formation zone, the fibre flow pattern is made up of a plurality of core streams, with each core stream initially being readily assignable to an individual fiberisation unit. The core streams which occur immediately below the fiberisation units, which core streams exhibit the energy of the propellant gas flows injected for fibre production and as a result of their elevated velocity represent regions of reduced static pressure, are located in relatively close mutual vicinity and exert a mutual suction effect which can lead to unstable oscillating flows in the individual core streams or in the fibre flow as a whole. The overall result is that, above the accumulating conveyor, there is a heterogeneous, spatially and temporally unstable flow pattern which, although in snapshot terms can be regarded as a downward flow, nevertheless exhibits locally a plurality of different flow components acting in the most varied of directions. The minutest changes in a boundary condition lead in this chaotic flow system to changes in the flow pattern which are difficult to control from the outside, which changes, in turn, adversely affect the degree of uniformity with which the nonwoven is formed and which are therefore undesirable.

In the boundary zone in particular around the fibre flows, fibres exhibiting rapid upward movements can also be observed. These upward streams in the boundary zone of the fibre flows are attributable to the fact that, as a rule, only a certain portion of the process air flowing in from above is completely extracted, while another portion at the side of the actual fibre flows is pushed upward again, or is sucked upward by partial vacuum zones in the region of the injected drawing gas flows. These air streams exhibit high flow velocities in an upward direction and entrain fibres in an upward direction to the area of fiberisation. In the case of fibre production by the blast drawing process, for example, suction of already solidified fibres into the nozzle slot together with the secondary air can lead to massive disruptions to production. In addition, the transport of already solidified fibres into the region of binder injection which, in the blast drawing process, is usually located at the entry zone of the chute, can lead to these fibre elements once again coming into contact with binder and then adhering to the chute wall or falling onto the nonwoven fabric as fibres with an excessive accumulation of binder, for example in the form of highly undesirable lumps.

In order to achieve orderly fibre deposition under these conditions, it is necessary to perform a plurality of fine adjustments for a given production process, so as to optimise, by trial and error, the fibre deposition conditions. Any change in the production conditions leads to the requirement that new fine adjustment be performed.

SUMMARY OF THE INVENTION

The object of the invention is to provide a process, and an apparatus for performing said process, in which a stable flow is produced in the chute, thus enabling properly defined, homogeneous fibre deposition.

In the first instance, the invention is based on the knowledge that the backflow regions of high velocity, which are formed as a result of the chaotic flow conditions and which, at first sight, appear to be highly undesirable, cannot be forced into a certain flow pattern by additional constructional measures such as, for example, baffles. Rather, in contrast to such an approach and in keeping with the invention, the backflow regions are rendered even larger in volume terms; initially this has the effect that the mean velocity of the backflows is reduced, thus substantially diminishing the extent to which fibres can be transported upward. Surprisingly, moreover, it has been revealed that, rather than a reduction in the backflow regions which are characteristic of the chaotic flow system leading to a stabilisation in the flow pattern, as might have been expected, it is, in contrast, the increase in the space available for the generation of backflow regions which leads to a stabilisation of the flow system. According to the invention, therefore, the backflow regions occurring on the outside of the fibre flows are not constricted but rather increased in volume terms.

Through this measure, the backflow regions have, on the one hand, room at the side to enable them to circulate slowly so that the upward velocities generated are reduced, thus already diminishing the tendency for fibres to be entrained upward; on the other hand, disadvantageous encrustations of binder-containing wool accumulations are avoided in that area of wall in which the stagnation point of the branching flow is located. Above the stagnation point, there is a backflow of process air, while below the stagnation point, the process air is extracted through the accumulating conveyor. If the volumes available for the backflow are too small, wool constituents in the region of the said stagnation point impinge onto the wall with a high velocity component perpendicular to the wall. This leads to undesirable encrustations. According to the invention, this stagnation point is therefore relocated a sufficient distance away from the external enveloping surfaces of the fibre flows so that the disruptive velocity component of the flow in the vicinity of the stagnation point is drastically reduced.

A further and essential aspect of the present invention lies in the fact that the extended backflow zone is dimensioned such that, over and beyond the advantages described so far, the wool to be deposited can no longer follow the backflow in the lower flow deflection area, i.e. it is effectively centrifuged out as in a cyclonic flow. In this process, the wool to be deposited is already separated within the actual chute from an appreciable portion of its associated process air. Consequently, this portion no longer needs to be sucked through the nonwoven fabric. This leads to advantages in respect of the necessary suction energy input, this being reduced owing to the substantially lower pressure loss a) of this partial flow, and b) of the remaining process air passing through the nonwoven fabric and/or the accumulating conveyor. Moreover, the differential pressure necessary for extracting the process air from the nonwoven fabric is also therefore reduced, so that the nonwoven fabric is deposited as a more voluminous material, thus facilitating the manufacture of products of low bulk density.

The overall result is a defined limitation of the fibre deposition area and thus of the nonwoven fabric formation zone, provided not by the walls of the chute but by a boundary area formed between the outsides of the fibre flows and those of the backflow regions.

If extraction of a portion of the process air is performed not through the nonwoven fabric but outside the nonwoven formation zone, the limitation of this zone is assisted by the process air flow, and the extraction of large volumes of air is facilitated.

The fact that the walls of the chute are positioned further out in a deliberately created dead flow zone means, however, that binder-containing wool material which has become deposited in the course of a certain time on the wall, can cure onto the wall more readily. If, in contrast, the chute walls mechanically limit the actual main flow, then they are also exposed to the stream forces acting here which, being mainly parallel to the wall surface, are more appropriate so that fibre encrustations become less probable. With the walls being positioned away from the main streams, the cooling of the walls therefore becomes even more important as a means of preventing, in accordance with the doctrine of published German patent application DE-OS 35 09 425, the curing of binder-containing fibre material onto the circumferential walls of the chute. With respect to further details, features and advantages of the cooling system for the walls of the chute, express reference is made to DE-OS 35 09 425, the full contents thereof being hereby incorporated by reference.

Further details, aspects and advantages of the present invention are revealed in the following description of an embodiment by reference to the drawing in which FIG. 1 shows a schematic representation by way of illustration of the process according to the invention and the apparatus according to the invention, with an accumulating conveyor in the form a flat conveyor belt, and FIG. 2 shows a further embodiment of the apparatus according to the invention with a drum-shaped accumulating conveyor.

DESCRIPTION OF THE PREFERRED EMBODIMENTS

Figure 1:
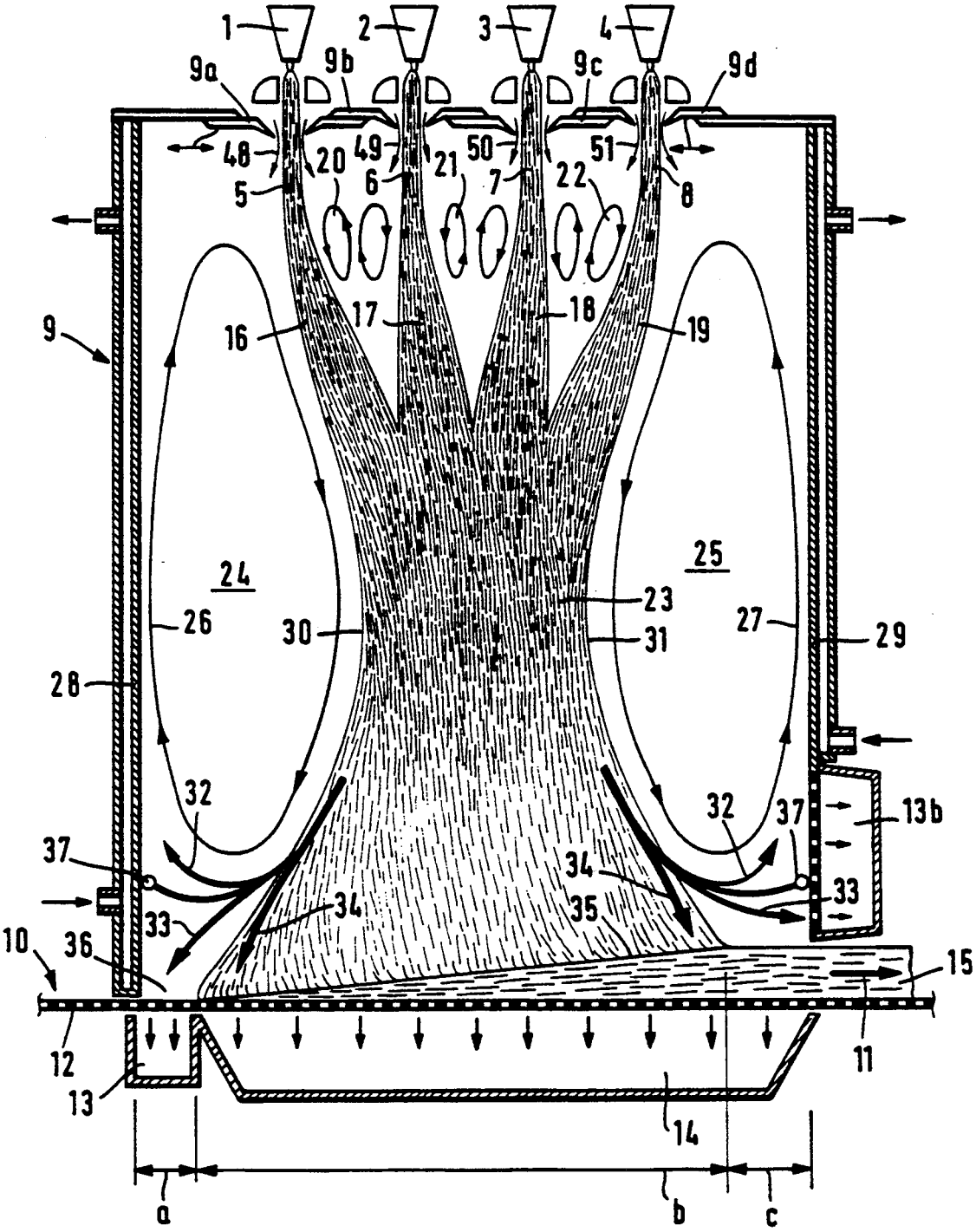

As is apparent from FIG. 1, free jet bundles 5, 6, 7 and 8, which are roughly wedge-shaped in their geometry, are produced by, in this illustrative example, four fiberisation units 1, 2, 3 and 4 operating in accordance with the blast drawing process, said free jet bundles 5, 6, 7 and 8 consisting of a fibre/gas/air/ binder mixture, being surrounded by a box-shaped chute 9, the upper terminations 9*a* to 9*e* of which are formed by covers 9*a* to 9*e* which limit the entry of ambient air. The chute covers 9*a* to 9*e* are of moveable design in respect of their cover area, and are also water-cooled in order to minimise the occurrence on them of encrustations of binder-containing wool constituents. Through their limiting effect on the sucked-in false air, signified by 48 to 51, backflows are generated, the extent of which is determined by the position and size of the remaining upper inlet cross sections of the chute. The bottom termination of the chute is formed by an accumulating conveyor 10 featuring a gas-permeable conveyor belt 12 which rotates in accordance with the direction indicated by arrow 11. If the fibre/gas/air mixture, which may also contain a binder, impinges on the accumulating conveyor 10, the gas/air mixture is extracted from below the accumulating conveyor 10 acting as a filter by, in this illustrative example, two extraction devices 13, 14, and the wool is deposited with the formation of a nonwoven fabric onto the accumulating conveyor 10 as a wool nonwoven 15.

The free jet bundles 5 to 8, which are initially still wedge-shaped in their geometry, produced by the fiberisation units 1 to 4, form at the entry zone of the chute 9 fibre flows 16, 17, 18, 19 with interposed eddy zones 20, 21, 22 of entrained process air. After a fall of a certain distance in the chute 9, the individual fibre flows 16 to 19 come into contact with one another and eventually join to form a main flow 23 which likewise features, on its outside, eddy zones 24, 25 with backflow regions 26, 27. According to the invention, the lateral limiting walls 28, 29 of the chute 9 are positioned at a sufficiently large distance from the outside edge 30, 31 of the fibre flows, i.e. the main flow 23, so that there is at least sufficient room for the eddy zones 24, 25 to ensure that the backflow regions 26, 27 which occur exhibit small mean velocities. In this way the problem is avoided whereby fibres from the main flow 23 are transported back up into the entry zone of the chute via the eddy zones 24, 25, in which entry zone they may be sprayed anew with binder.

The shape of the eddy zones 24, 25 leads, in the edge zone of the main flow 23, to a division in the downwardly directed air stream into a portion 32 which is returned upward in the backflow region 26, and a portion 33 which is extracted in the vicinity of, but outside, the nonwoven formation zone 35, namely in a zone 36 with a width a in the illustrative example, by the extraction device 13. The remaining portion 34 is sucked through the nonwoven fabric 15 in the nonwoven formation zone 35 with a width b by extraction device 14. Depending on requirements, instead of extraction device 14, several such extraction chambers can, of course, be provided, duly designed and arranged in accordance with the layer growth of the nonwoven fabric. Moreover, extraction chamber 13 in particular can be dispensed with or take the form of a—if necessary throttlable—part of extraction device 14.

As shown in the right-hand part of the illustration, a large-volume flow is also generated in the region of maximum nonwoven layer thickness, in accordance with the invention, so that appreciable upward wool transport is avoided. To this, a zone c where there is no nonwoven formation can be connected in a similar manner, from which zone c a further partial flow of process air **33*b* can be extracted by an extraction device 13*b*** which is not shown in any further detail and which is located outside the nonwoven formation and conveying region.

The distance of the lateral limiting walls 28, 29 of the chute from the outside edge 30, 31 of the main flow 23, and also the width a of zone 36, and the width b of the nonwoven formation zone 35 are dimensioned in this respect such that disruptive velocity components perpendicular to the limiting wall 28, 29 in the vicinity of the stagnation point signified by 37 are drastically reduced in magnitude. It is known from earlier measurements that these velocities can easily lie in a range from approx. 10 to 20 m/s. According to the invention they are reduced to below 10 to 20% of these values.

The following data are provided to serve as an indication of the volumes involved in the case of the claimed backflow regions:

Given a process gas volume flow of, for example 9,000 $m^3/h$ (STP) per fiberisation unit, the volume of circulating backflow generated between the end walls 28, 29 and the enveloping surfaces 30, 31 near to the wall is approx. 2,500 $m^3/h$ (STP). According to the previously customary design in respect of the distance between fiberisation units 1 and 4 on the one hand, and the end walls 28 and 29 respectively on the other, maximum velocities of the upward flows near to the wall of approx. 4 m/s are known to have occurred. These velocities are higher than the drop velocity of wool flocks, so that a substantial proportion of wool is taken upward again into the chute entry zone.

With the creation in accordance with the invention of sufficiently sized backflow regions, the circulating backflow volumes of 2,500 $m^3/h$ (STP), although only having undergone insignificant change, feature substantially reduced upward velocity with values falling to below 2 m/s and preferentially below 1 m/s.

As a result of the likewise advantageous introduction of a nonwoven-free extraction region a and/or c, approx. 20 to 80%, and preferentially 40 to 60%, of the process air volume from the fiberisation units 1 and 4 near the wall is, in addition, extracted outside the nonwoven formation zone b, without the need to overcome a pressure loss as a result of flow resistance at the nonwoven. In the case of the four fiberisation units in the illustrative example, a portion of 10 to 40% of the process air is extracted without any appreciable pressure loss, and thus with extreme cost-efficiency.

As a further advantage, reference is made to the fact that, if the edge zone extension according to the invention is not provided, the 9,000 $m^3/h$ (STP) process air per fiberisation unit mentioned in the example numerical data above can only be adhered to in the case of very coarse wool (such as is required, for example, for automotive exhaust mufflers) featuring correspondingly higher drop velocities and a lower level of permeation resistance. In the case of finer wool, the proportion of false air sucked into the chute per fiberisation unit has to be increased by approx. 3,000 to 6,000 $m^3/h$ (STP) in order to avoid upward wool transport. By this means, the position of the backflow regions which are formed is shifted so far down that wool egress out of the chute cover area no longer takes place. Compared with these practical operating data, the invention results in an advantageous reduction of the requisite total volume of exhaust air per fiberisation unit of approx. 20 to 60%, and on average approx. 30%.

Figure 2:
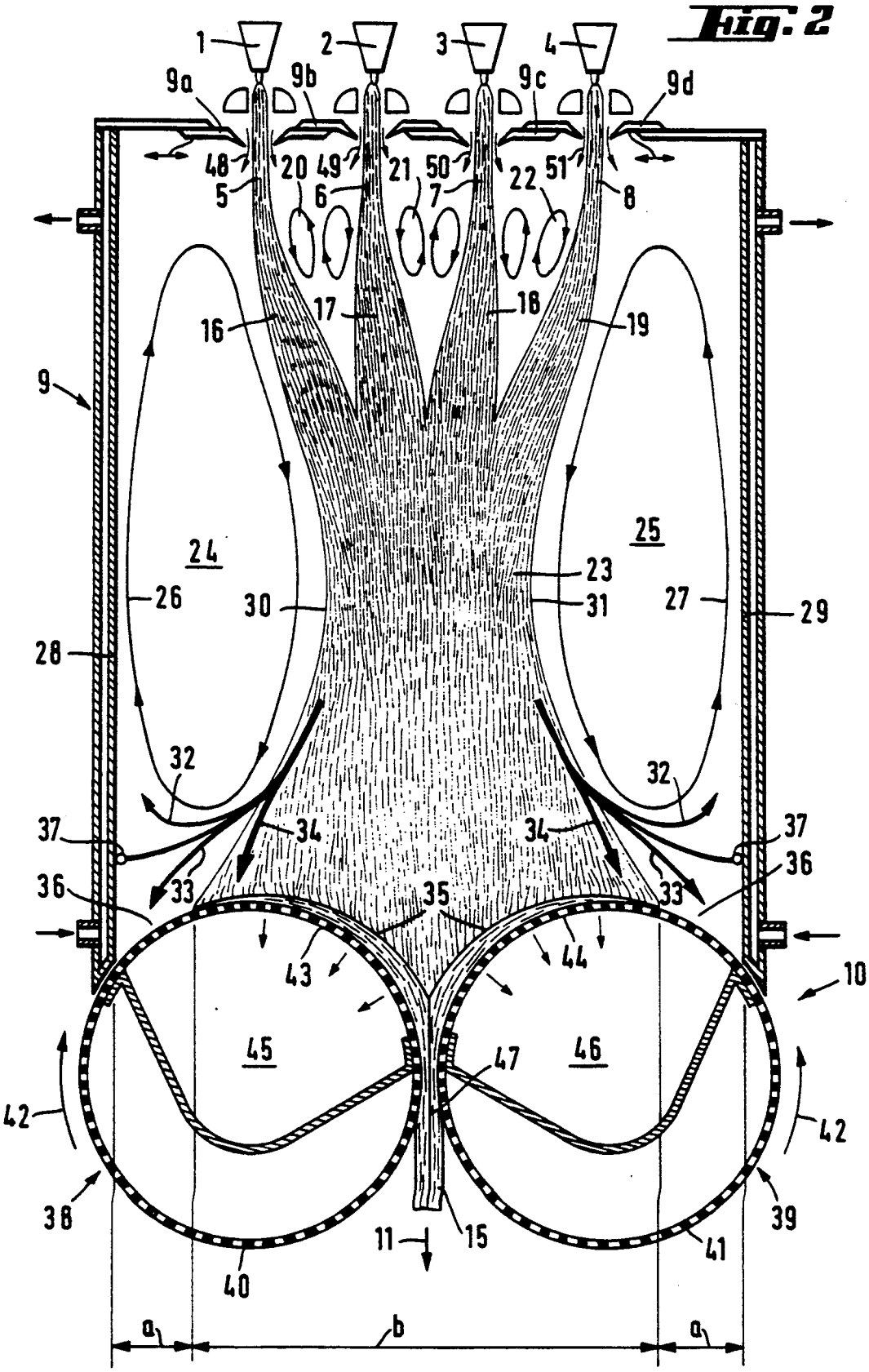

FIG. 2 shows a further embodiment of the apparatus according to the invention, in which the accumulating conveyor 10 is designed in the form of drums 38, 39. The drums 38 and 39 each feature a rotating, perforated (gas-permeable) rotor 40 and 41, each of which is powered by a motor (not depicted in any further detail in FIG. 2) in the direction of the arrows 42, i.e. the conveying direction. Furthermore, arranged inside the drums 38 and 39 is an extraction device, not depicted in any further detail, the suction pressure generated by which is active only in suction chambers 45 and 46 located below the curved suction areas 43 and 44. The distance between the two drums 38 and 39 creates a so-called discharge gap 47, the width of which is essentially to be matched to the thickness of the nonwoven 15 being produced. In order to adjust the width of the discharge gap 47, one of the two drums 38, 39 may be of swivellable design. In order to optimise the large-volume flow structure, the extraction devices 45 and 46 may, in particular, be divided such that the suction pressure in the nonwoven-free suction zones a is adjustable.

In this embodiment, the extraction zone a shown in example 1 (see FIG. 1) is arranged to particular advantage as, owing to the two, initially nonwoven-free perforated surfaces entering the chute, there are two extraction zones a formed which, without any great degree of design sophistication, serve the purpose according to the invention of extracting a considerable portion of the process air from outside the nonwoven deposition surface. This eliminates what would be, in itself, a more difficult problem, namely that of providing a further extraction device **13*b* analog to region c in FIG. 1**. By this dual utilisation of the advantages of a nonwoven-free zone a, the formation of zones c in this concept can be avoided to advantageous effect.

We claim:

1. A process for continuous production of mineral wool nonwoven fabrics, comprising the steps of:

discharging a generally vertical stream of mineral wool fibers together with process air into a chute;

accumulating the fibers on a nonwoven formation zone of a conveyor beneath the chute;

applying suction with suction means and through the nonwoven formation zone of the conveyor to extract a portion of the process air through the conveyor and adhere the fibers to the conveyor, wherein another portion of the process air is deflected upward from the conveyor; and leaving sufficient space between the stream of mineral wool and at least one wall of said chute that the upwardly deflected process air has a velocity no higher than a drop velocity of wool flocks in the upwardly deflected process air.

2. The process of claim 1 wherein said velocity is less than 2 meters/sec.

3. An apparatus for the continuous production of mineral wool nonwoven fabrics, comprising:

at least one fiberization unit for discharging a stream of mineral wool fibers;

a generally vertical chute into which the stream may be discharged together with process air;

a conveyor beneath the chute and on which the fibers may accumulate; and a suction device extracting a portion of the process air through a nonwoven formation zone of the conveyor so as to accumulate and adhere the fibers onto the conveyor, wherein another portion of the process air is deflected upward from the conveyor;

wherein at least one wall of said chute is sufficiently spaced from the stream of mineral wool that the upwardly deflected process air has a velocity no higher than a drop velocity of wool flocks in the upwardly deflected process air.

4. The apparatus of claim 3 wherein said at least one wall is sufficiently spaced that said velocity is less than 2 meters/sec.

* * * * *